US006668535B2

(12) United States Patent
Tanahashi et al.

(10) Patent No.: US 6,668,535 B2
(45) **Date of Patent: *Dec. 30, 2003**

(54) HEAT-RESISTANT CRIMPED YARN

(75) Inventors: Mitsuhiko Tanahashi, Gifu (JP); Kazuhiko Kosuge, Tokyo (JP); Takeshi Hatano, Tokyo (JP); Iori Nakabayashi, Otsu (JP)

(73) Assignee: Du Pont-Toray Co., Ltd., Tokyo (JP)

( * ) Notice: Subject to any disclaimer, the term of this patent is extended or adjusted under 35 U.S.C. 154(b) by 0 days.

This patent is subject to a terminal disclaimer.

(21) Appl. No.: 09/913,851

(22) PCT Filed: Dec. 19, 2000

(86) PCT No.: PCT/JP00/09006

§ 371 (c)(1),
(2), (4) Date: Oct. 3, 2001

(87) PCT Pub. No.: WO01/46503

PCT Pub. Date: Jun. 28, 2001

(65) Prior Publication Data

US 2003/0000197 A1 Jan. 2, 2003

(30) Foreign Application Priority Data

| | | |
|---|---|---|
| Dec. 20, 1999 | (JP) | 10-361825 |
| Mar. 24, 2000 | (JP) | 2000-84859 |
| Mar. 24, 2000 | (JP) | 2000-84860 |

(51) Int. Cl.[7] ..... D02G 1/00; D02G 3/02

(52) U.S. Cl. ..... 57/289; 57/290; 57/309; 57/246

(58) Field of Search ..... 57/245–247, 282, 57/284, 285, 289, 290, 309, 351; 28/218; 428/364, 394, 395

(56) References Cited

U.S. PATENT DOCUMENTS 3,333,441 A * 8/1967 Soussloff et al. ..... 66/147
3,629,053 A * 12/1971 Kimura et al. ..... 428/374

(List continued on next page.)

FOREIGN PATENT DOCUMENTS

| | | |
|---|---|---|
| EP | 0330163 | 8/1989 |
| JP | 63-75130 | 4/1988 |
| JP | 06-280120 | 10/1994 |
| JP | 09-157981 | 6/1997 |
| JP | 10-130990 | 5/1998 |

OTHER PUBLICATIONS

Naohisa Ohshima, Structural Studies for Cellulosic Fibers Treated under High Pressure Steam (III), Preprints of Annual Meeting of Sen–i Gakkai (Kyoto), vol. 55, No. 1, p. 141 (2000) with English translation.

(List continued on next page.)

*Primary Examiner*—John J. Calvert
*Assistant Examiner*—Shaun R Hurley
(74) *Attorney, Agent, or Firm*—Wenderoth, Lind & Ponack, L.L.P.

(57) ABSTRACT

The invention provides heat-resistant crimped yarn, of which the constituent heat-resistant high-functional fibers are prevented as much as possible from being deteriorated under heat in the process of producing the yarn. Not losing excellent properties of heat resistance and flame retardancy intrinsic to the heat-resistant high-functional fibers, the crimped yarn has a good elongation percentage in stretch, a good stretch modulus of elasticity and a good appearance, and it fluffs little and releases little dust. The heat-resistant crimped yarn comprises heat-resistant high-functional fibers, and is characterized in that it does not deteriorate under heat, and that its elongation percentage in stretch is at least 6%, its stretch modulus of elasticity is at least 40%, and its tenacity falls between 0.15 and 3.5 N/tex.

11 Claims, 3 Drawing Sheets

U.S. PATENT DOCUMENTS

| | | | | | |
|---|---|---|---|---|---|
| 3,705,823 | A | * | 12/1972 | Hosokawa et al. | 427/389 |
| 3,977,173 | A | * | 8/1976 | Kosaka et al. | 57/205 |
| 4,539,805 | A | * | 9/1985 | Ukai et al. | 57/290 |
| 4,912,821 | A | * | 4/1990 | Mutsuo | 28/265 |
| 4,957,807 | A | * | 9/1990 | McCullough et al. | 428/222 |
| 6,335,093 | B1 | * | 1/2002 | Mori et al. | 428/370 |

OTHER PUBLICATIONS

Mitsuhiko Tanahashi, Transformation of Cellulose Crystalline Structures by Swelling Solvents and High Pressure Steam Treatments, Outlines of lecture at the 7$^{th}$ Annual Meeting of the Cellulose Society of Japan (Tokyo), p. 13–14 (2000) with English abstract.

Naohisa Ohshima, Changes on Structure of Cellulose Microfibrils by High–pressure Steaming, Outlines of lecture at the 7$^{th}$ Annual Meeting of the Cellulose Society of Japan (Tokyo), p. 79 (2000) with English abstract.

Naohisa Ohshima, Structural Analysis for Cellulosic Fibers Treated under High Pressure Stream, Proceedings of the 5$^{th}$ Asian Textile Conference (Kyoto), vol. 2, p. 1206–1209 (1999).

Naohisa Oshima, Structural Studies for Cellulosic Fibers Treated under High Pressure Steam, Preprints of meeting of Sen–i Gakkai (Gifu), F–213 (1998) with English translation.

Ihoka Shimohata, Fixation Mechanism of Natural Fibers by High–pressure Steam–treatment, Preprints of meeting of Sen–i Gakkai (Sakai), F–34 (1997) with English translation.

Mitsuhiko Tanahashi, Shape–memorization of Cellulosics by High–Pressure Stream–treatment, Outlines of lecture at the 2$^{nd}$ Meeting of the Cellulose Society of Japan (Uji), p. 39–40 (1995) with English abstract.

Mitsuhiko Tanahashi, Fixation and improvement of cellulosic fiber form by high–pressure steam treatment (II), Outlines of the 42$^{nd}$ Meeting of the Japan Wood Research Society, p. 371 (1992) with English translation.

Mitsuhiko Tanahashi, Permanent Set of Natural Fibers and Textiles by High–pressure and high–temperature Steam Treatment, Preprints of meeting of Sen–i Gakkai, F–17 (1992) with English translation.

* cited by examiner

HEAT-RESISTANT CRIMPED YARN

This application is a 371 of PCT/JP00/09006 filed Dec. 19, 2000.

TECHNICAL FIELD

The present invention relates to heat-resistant crimped yarn comprising heat-resistant high-functional fibers such as aramid fibers, and to a method for producing it. More precisely, the invention relates to heat-resistant crimped yarn which has not only excellent heat resistance, flame retardancy and high tenacity characteristics, but also a good elongation percentage in stretch, a good stretch modulus of elasticity and a good appearance, and which fluffs little and releases little dust; and relates to a method for producing the heat-resistant crimped yarn characterized by treatment with high-temperature high-pressure steam or high-temperature high-pressure water or by dry heat treatment.

The invention also relates to a bulky and stretchable fibrous product of the heat-resistant crimped yarn. In particular, it relates to working clothes and gloves necessary for protecting workers' bodies and hands in various workplaces, for example, those for steel workers working around high-temperature blast furnaces, those for sheet metal welders, those for farmers, those for painters in the field of automobiles or electric and electronic appliances, those for workers in the field of precision machines, airplanes or information systems, those for sportsmen, those for surgeons, etc.

BACKGROUND ART

General thermoplastic synthetic fibers such as nylon or polyester fibers melt at about 250° C. or so. However, heat-resistant high-functional fibers such as aramid fibers, holaromatic polyester fibers and polyparaphenylenebenzobisoxazole fibers do not melt at about 250° C. or so, and their decomposition temperature is about 500° C. or so and is high. The critical oxygen index of the non-heat-resistant general fibers, nylon or polyester fibers is about 20 or so, and the fibers well burn in air. However, the critical oxygen index of the heat-resistant high-functional fibers such as those mentioned above is at least about 25, and the fibers may burn in air when they are brought near to a heat source of flames, but could not continue to burn if they are moved away from the flames. To that effect, the heat-resistant high-functional fibers have excellent heat resistance and flame retardancy. Therefore, aramid fibers, a type of heat-resistant high-functional fibers are favorable to clothes for use in high risk of exposure to flames and high temperatures, for example, for fireman's clothes, racer's clothes, steelworker's clothes, welder's clothes, etc. Above all, para-aramid fibers having the advantages of heat resistance and high tenacity are much used for sportsman's clothes, working clothes, ropes, tire cords and others that are required to have high tear strength and heat resistance. In addition, as they are hardly cut with edged tools, the fibers are also used for working gloves. On the other hand, meta-aramid fibers are resistant to heat and have good weather resistance and chemical resistance, and they are used for fireman's clothes, heat-insulating filters, heat-resistant dust-collecting filters, electric insulators, etc.

Heretofore, when the heat-resistant high-functional fibers are formed into fibrous products such as clothes, they are used merely in the form of non-crimped filaments or spun yarn. However, even when such non-crimped yarn of filaments or spun yarn is worked into fabrics and formed into clothes such as fireman's clothes, racer's clothes and working clothes, the resulting clothes are poorly elastic as the yarn itself is not elastic. As a result, when the clothes are worn, they are problematic in that their feel is not good and they are unsuitable to exercises and working activities.

In particular, working gloves made of conventional non-crimped yarn are unsuitable to use in the industrial fields of airplanes, information systems and precision machines in which precision parts are handled, as they do not well fit with worker's hands. Using the gloves in those industrial fields often results in the reduction in the working efficiency. In the field of medicine, for example, in the field of surgical operations of treating AIDS cases and the like that will cause infection by blood, the surgeons wear rubber gloves or elastomer gloves (hereinafter referred to as rubber gloves) to protect themselves from the patient's blood. Ambulance men take care of unspecified, wounded or sick persons, and they wear rubber gloves to protect themselves from the blood and body fluid of patients who are not yet identified as infectious. However, rubber gloves will be readily broken by operation tools such as surgical knives, and they could not completely protect the medical and surgical workers such as physicians, surgeons and ambulance men, from surgical knives, syringe needles and others stained with patient's blood. In that situation, it may be taken into consideration to wear woven or knitted gloves of heat-resistant high-functional fibers with high mechanical strength such as those mentioned above, inside rubber gloves. However, as mentioned hereinabove, the conventional gloves of heat-resistant high-functional fibers are poorly elastic and therefore lower the working efficiency of the medical and surgical workers such as physicians, surgeons and ambulance men. Accordingly, thin, elastic and tough gloves capable of being worn inside rubber gloves without detracting from the working efficiency are desired.

Heretofore, however, spun yarn is produced by spinning short fibers generally having a length of around 38 mm or around 51 mm or so, and the edges of the short fibers often protrude out of the surface of the spun yarn to form fluffs therearound. Working clothes and gloves made of spun yarn of heat-resistant high-functional fibers release the fluffs, when rubbed while they are used. Therefore, using them in clean rooms with no dust in air therein, or in painting factories in which dust, when adhered to the surfaces of painted products, detracts from the commercial value of the products is problematic. In that situation, working clothes, gloves and other fibrous products of heat-resistant high-functional fibers, which fluff little and release little dust are desired.

As described hereinabove, fibrous products of non-crimped yarn of heat-resistant high-functional fibers are unsuitable to exercises and working activities, and they fluff and release dust. In order to solve the problems, it is desired to provide heat-resistant crimped which has a good elongation percentage in stretch, a good stretch modulus of elasticity and a good appearance, not losing the excellent characteristics of good heat resistance and flame retardancy intrinsic to heat-resistant high-functional fibers, and which fluffs little and releases little dust.

To meet the requirements now in the market, various studies and proposals have been made, relating to heat-resistant crimped yarn and to a method for crimping heat-resistant high-functional fibers (Japanese Patent Laid-Open Nos. 19818/1973, 114923/1978, 27117/1991). Concretely, one proposal is to apply a method for crimping ordinary thermoplastic synthetic fibers such as nylon or polyester fibers. For example, known is a method of forcedly crimping high-elasticity fibers such as para-aramid fibers mixed with low-elasticity fibers (Japanese Patent Laid-Open No. 192839/1989). Also known is crimped yarn produced by a false-twisting method in which aramid fibers are false-twisted and crimped by the use of a non-contact heater heated at a temperature not lower than that at which the fibers begin to decompose but lower than the decomposition point of the fibers (for meta-aramid fibers, the temperature is 390° C. or higher but lower than 460° C.), and thereafter subjected to thermal relaxation (Japanese Patent Laid-Open No. 280120/1994).

However, the known methods could not still solve all the outstanding technical problems which are how to produce high-quality crimped yarn having a good elongation percentage in stretch and a good stretch modulus of elasticity; how to prevent yarn quality deterioration, for example, tenacity reduction and color change under heat of yarn produced, and how to prevent the yarn from fluffing and from being cut or broken; and how to realize easy process control, simplification of production lines, increased productivity, and cost reduction. At present, therefore, no one has succeeded in industrial production of heat-resistant crimped yarn having a good elongation percentage in stretch and so on, not losing the physical properties intrinsic to the constituent fibers.

DISCLOSURE OF THE INVENTION

In view of the problems in the related art noted above, one object of the present invention is to provide heat-resistant crimped yarn which comprises heat-resistant high-functional fibers and has a good elongation percentage in stretch, a good stretch modulus of elasticity and a good appearance, for which the quality deterioration of the constituent heat-resistant high-functional fibers through heat treatment in the production process is reduced as much as possible, and which therefore does not lose the excellent properties of good heat resistance and flame retardancy intrinsic to the heat-resistant high-functional fibers, and which fluffs little and releases little dust.

Another object of the invention is to provide a method for producing the heat-resistant crimped yarn practicable in point of the productivity, the necessary equipment and the production costs.

Still another object of the invention is to provide fibrous products, especially gloves of which the advantages are that (a) they are elastic and resistant to heat, and they have good mechanical strength and a good appearance, (b) they well fit wearer's bodies including hands and are suitable to exercises and working activities, (c) they fluff little and release little dust, and (d) they are easy to produce on an industrial scale as the process control is easy, the productivity is high and the production costs is low.

We, the present inventors have assiduously studied so as to attain the objects as above, and, as a result, have found that, when heat-resistant high-functional fibers are used in the form of crimped yarn having a specific elongation percentage in stretch, a specific stretch modulus of elasticity and a specific tenacity and not deteriorating under heat, in producing fibrous products, then the suitability of the resulting fibrous products to exercises and working activities is significantly improved, as compared with those used in the form of non-crimped yarn such as filaments or spun yarn, and that the fibrous products fluff little and release little dust even when rubbed while they are used. The fibrous products, which we have produced in the manner as above, solve all the outstanding problems in the prior art mentioned hereinabove.

We have further studied the method for producing the heat-resistant crimped yarn, and, as a result, have found that, when heat-resistant high-functional fiber filaments are first twisted in a primary twisting step, then heat-set for twist fixation through treatment with high-temperature high-pressure steam or high-temperature high-pressure water or through dry heat treatment, and finally untwisted by again twisting them in the direction opposite to the primary twisting direction, then the above-mentioned heat-resistant crimped yarn of high quality can be produced.

Heat-resistant high-functional fiber filaments are slippery. Therefore weaving or knitting them into gloves by the use of weaving or knitting machines is often difficult. In this connection, we have found that the heat-resistant crimped yarn of the invention solves the problem. We have further found that bulky and stretchable fibrous products such as gloves made of the heat-resistant crimped yarn of the invention have an advantage in that they fluff little and release little fluff. As so mentioned hereinabove, spun yarn of short fibers fluffs since the edges of the constituent short fibers protrude out of the surface of the yarn, and therefore, fibrous products made of spun yarn of heat-resistant high-functional fibers release fluffs when rubbed while they are used. As opposed to such spun yarn, the heat-resistant crimped yarn of the invention is composed of long fibers and therefore has no fluffs on its surface. Not having edges of short fibers therearound, therefore, fibrous products such as working clothes made of the heat-resistant crimped yarn of the invention fluff little and therefore do not release fluffs even when rubbed while they are used.

In the industrial fields of precision machines, airplanes and information systems, for example, in the working site for fabricating electronic parts for airplanes, computers and the like, the working space must be kept all the time clean. If the working gloves used in the site are deteriorated, they will soon release fibrous dust in the working space, in which, however, the trouble is unacceptable. Accordingly, the fibrous products especially the gloves of the invention are especially useful in these industrial fields, as having the advantage of fluffing little and releasing little dust. In painting factories in which construction materials of aluminum, electric and electronic appliances for household use, or automobile parts are painted, fibrous fluffs and dust, if they have been adhered to the surfaces of the painted products, detract from the commercial value of the products. In these, therefore, the fibrous products especially the gloves of the invention are also useful, since they fluff little and release little dust.

Having further studied, we, the present inventors have completed the present invention.

Specifically, the invention relates to the following:

(1) Heat-resistant crimped yarn not deteriorating under heat, which comprises heat-resistant high-functional fibers having a mono-filament fineness of from 0.02 to 1 tex, and of which the elongation percentage in stretch is at least 6%, the stretch modulus of elasticity is at least 40%, and the tenacity falls between 0.15 and 3.5 N/tex;

(2) The heat-resistant crimped yarn of above (1), wherein the heat-resistant high-functional fibers are para-aramid fibers, holaromatic polyester fibers or polyparaphenylene-benzobisoxazole fibers, and of which the tenacity falls between 0.5 and 3.5 N/tex;

(3) The heat-resistant crimped yarn of above (2), for which the para-aramid fibers are polyparaphenylene-terephthalamide fibers;

(4) The heat-resistant crimped yarn of above (1), wherein the heat-resistant high-functional fibers are meta-aramid fibers, and of which the elongation percentage in stretch falls between 50 and 300%;

(5) The heat-resistant crimped yarn of above (4), wherein the meta-aramid fibers are polymetaphenylene-isophthalamide fibers;

(6) A bulky and stretchable fibrous product of the heat-resistant crimped yarn of any of above (1) to (5), wherein the amount of the heat-resistant crimped yarn is for at least 50% of the fibrous part of the product;

(7) The bulky and stretchable fibrous product of above (6), which is for gloves;

(8) The gloves of above (7) for use in the industrial fields of precision machines, airplanes, information systems, automobiles, electric and electronic appliances, and in the field of surgical operations and sanitary facilities;

(9) The bulky and stretchable fibrous product of above (6), which is for fireman's clothes, racer's clothes, steel worker's clothes, welder's clothes or painter's clothes;

(10) A method for producing heat-resistant crimped yarn, which comprises twisting heat-resistant high-functional fiber filaments, heat-setting them through treatment with high-temperature high-pressure steam or high-temperature high-pressure water, and thereafter untwisting them;

(11) The method for producing heat-resistant crimped yarn of above (10), wherein the heat-resistant high-functional fiber filaments are twisted to a twist parameter, K represented by the following formula, of from 5,000 to 11,000, and are heat-set through treatment with high-temperature high-pressure steam or high-temperature high-pressure water at a temperature falling between 130 and 250° C.:

$$K=t\times D^{1/2}$$

wherein t indicates the count of twists (/m) of the filaments; and D indicates the fineness (tex) thereof;

(12) The method for producing heat-resistant crimped yarn of above (10) or (11), wherein the heat-resistant high-functional fibers are selected from the group consisting of para-aramid fibers, meta-aramid fibers, holaromatic polyester fibers and polyparaphenylene-benzobisoxazole fibers;

(13) The method for producing heat-resistant crimped yarn of above (12), wherein the para-aramid fibers are polyparaphenylene-terephthalamide fibers;

(14) The method for producing heat-resistant crimped yarn of any of above (10) to (13), wherein the heat-resistant crimped yarn produced has an elongation percentage in stretch of at least 6% and a stretch modulus of elasticity of at least 40%;

(15) A bulky and stretchable fibrous product made of the heat-resistant crimped yarn obtained in the production method of above (12);

(16) A method for producing heat-resistant crimped yarn, which comprises twisting heat-resistant high-functional fiber filaments, heat-setting them through dry heat treatment at a temperature not higher than the decomposition point of the heat-resistant high-functional fibers, and thereafter untwisting them;

(17) The method for producing heat-resistant crimped yarn of above (16), wherein the heat-resistant high-functional fiber filaments are twisted to a twist parameter, K represented by the following formula, of from 5,000 to 11,000, then heat-set through dry heat treatment at a temperature falling between 140 and 390° C., and thereafter untwisted:

$$K=t\times D^{1/2}$$

wherein t indicates the count of twists (/m) of the filaments; and D indicates the fineness (tex) thereof;

(18) The method for producing heat-resistant crimped yarn of above (16) or (17), wherein the process of twisting the heat-resistant high-functional fiber filaments, heat-setting them through dry heat treatment and thereafter untwisting them is effected continuously;

(19) The method for producing heat-resistant crimped yarn of any of above (16) to (18), wherein the dry heat treatment is effected at a temperature falling between 200 and 300° C.;

(20) The method for producing heat-resistant crimped yarn of any one of above (16) to (19), wherein the heat-resistant high-functional fibers are selected from the group consisting of para-aramid fibers, meta-aramid fibers, holaromatic polyester fibers and polyparaphenylene-benzobisoxazole fibers;

(21) The method for producing heat-resistant crimped yarn of any one of above (16) to (20), wherein the para-aramid fibers are polyparaphenylene-terephthalamide fibers;

(22) The method for producing heat-resistant crimped yarn of any one of above (16) to (21), wherein the heat-resistant crimped yarn produced has an elongation percentage in stretch of at least 6% and a stretch modulus of elasticity of at least 40%;

(23) A bulky and stretchable fibrous product made of the heat-resistant crimped yarn obtained in the method of any one of above (16) to (22);

(24) A method for producing heat-resistant crimped yarn, which comprises knitting heat-resistant high-functional fiber filaments into a knitted fabric, then heat-setting the knitted fabric through dry heat treatment or through treatment with high-temperature high-pressure steam or high-temperature high-pressure water, and thereafter unknitting it;

(25) The method for producing heat-resistant crimped yarn of above (24), wherein the knitted fabric of heat-resistant high-functional fiber filaments is heat-set through treatment with high-temperature high-pressure steam or high-temperature high-pressure water at a temperature falling between 130 and 250° C. for a period of time falling between 2 and 100 minutes, and then this is unknitted;

(26) The method for producing heat-resistant crimped yarn of above (24), wherein the knitted fabric of heat-resistant high-functional fiber filaments is heat-set through with dry heat treatment at a temperature falling between 140 and 390° C., and then this is unknitted;

(27) The method for producing heat-resistant crimped yarn of above (25) or (26), wherein the heat-resistant crimped yarn produced has the elongation percentage in stretch of at least 6.5%;

(28) Gloves made by weaving or knitting yarn that contains crimped yarn of heat-resistant high-functional fibers;

(29) Gloves of above (28), wherein the crimped yarn has an elongation percentage in stretch of from 6% to 30% and a stretch modulus of elasticity of from 40 to 100%;

(30) Gloves of above (28) or (29), wherein the heat-resistant high-functional fibers are selected from the group consisting of para-aramid fibers, meta-aramid fibers, holaromatic polyester fibers and polyparaphenylene-benzobisoxazole fibers;

(31) Gloves of above (30), wherein the para-aramid fibers are polyparaphenylene-terephthalamide fibers;

(32) Gloves of any of above (28) to (31), wherein the crimped yarn of heat-resistant high-functional fibers is produced by twisting heat-resistant high-functional fiber filaments, heat-setting them through dry heat treatment or through treatment with high-temperature high-pressure steam or high-temperature high-pressure water, and thereafter untwisting them; and

(33) Gloves of any of above (28) to (32), which are for use in the industrial fields of precision machines, airplanes, information systems, or in the field of surgical operations and sanitary facilities.

BEST MODES OF CARRYING OUT THE INVENTION

Figure 1:
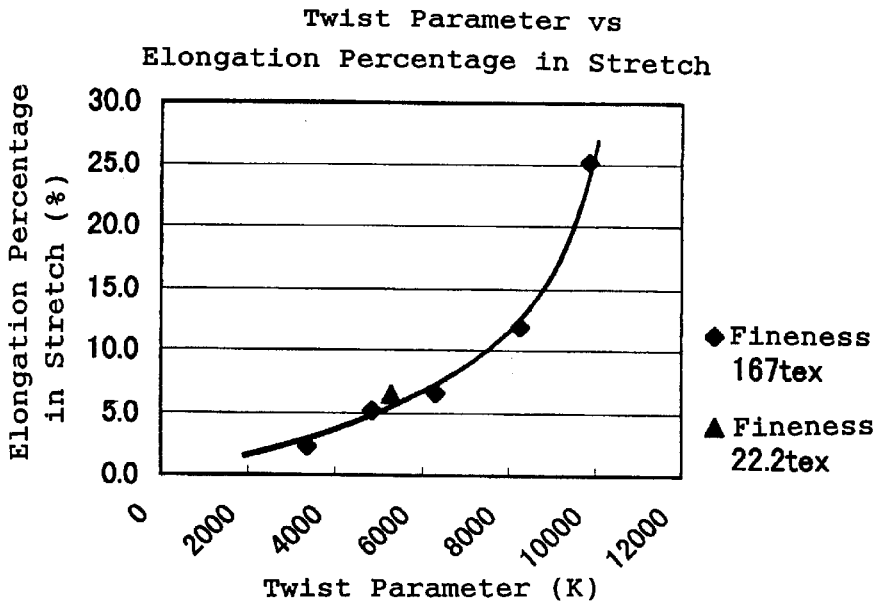
FIG. 1 shows the relationship between the twist parameter of fiber filaments not treated with saturated steam, and the elongation percentage in stretch, one typical parameter, of crimped yarn.

The invention provides heat-resistant crimped yarn not deteriorating under heat, which comprises heat-resistant high-functional fibers having a monofilament fineness of from 0.02 to 1 tex, and of which the elongation percentage in stretch is at least about 6%, the stretch modulus of elasticity is at least about 40%, and the tenacity falls between about 0.15 and 3.5 N/tex or so.

Preferably, the heat-resistant high-functional fibers for use in the invention have a critical oxygen index of at least about 25 and a thermal decomposition point measured in differential scanning calorimetry of not lower than about 400° C. The critical oxygen index indicates the flame retardancy of the fibers; and the thermal decomposition point indicates the heat resistance of the fibers. Examples of the fibers are aramid fibers, holaromatic fibers (e.g., Kuraray's Vectran®), polyparaphenylene-benzoxazole fibers (e.g., Toyobo's Zylon®), polybenzimidazole fibers, polyamidimide fibers (e.g., Rhone-poulenc industries's Kermel®), polyimide fibers, etc. Aramid fibers include meta-aramid fibers and para-aramid fibers. Examples of meta-aramid fibers are meta-holaromatic polyamide fibers such as polymetaphenylene-isophthalamide fibers (e.g., DuPont's Nomex®), etc. Examples of para-aramid fibers are para-holaromatic polyamide fibers such as polyparaphenylene-terephthalamide fibers (e.g., Toray-DuPont's Commercial product named Kevlar®), copolyparaphenylene-3,4'-diphenylether-terephthalamide fibers (e.g., Teijin's Commercial product named Technora®), etc.

The heat-resistant crimped yarn of the invention may be composed of one type of heat-resistant high-functional fibers such as those mentioned above, or may comprise two or more different types of such heat-resistant high-functional fibers. It may be in the form of conjugated yarn, combined or twisted with any other known fibers such as polyester, nylon, polyvinyl alcohol fibers, etc.

The monofilament fineness of the heat-resistant high-functional fibers to be used in the invention falls between about 0.02 and 1 tex or so, but preferably between about 0.05 and 0.6 tex or so, more preferably between about 0.08 and 0.5 tex or so, for the flexibility of the heat-resistant crimped yarn of the invention and for easy production of the yarn.

The total fineness of the heat-resistant high-functional fiber filaments to be used in the invention is not specifically defined so far as the thickness of the filaments is enough for their process ability into twisted yarn and knitted fabrics. In view of the step of twisting the filaments into twisted yarn and the step of knitting them into knitted fabrics in the process of producing the heat-resistant crimped yarn of the invention, however, the total fineness of the fiber filaments preferably falls between about 5 and 5000 tex or so.

The fineness referred to herein is indicated by a unit of tex, as so stipulated in JIS L 0101 (1999). For example, 1 tex means that a fiber filament having a length of 1000 m has a weight of 1 g; and 10 tex means that a fiber filament having a length of 1000 m has a weight of 10 g. Fiber filaments having a larger value of tex are thicker.

One preferred embodiment of the heat-resistant crimped yarn of the invention, which comprises heat-resistant high-functional fibers selected from para-aramid fibers, holaromatic polyester fibers or polyparaphenylene-benzobisoxazole fibers, has an elongation percentage in stretch of at least about 6% or so, more preferably from about 10 to 50% or so, even more preferably from about 15 to 40% or so, a stretch modulus of elasticity of at least about 40% or so, more preferably from about 50 to 100% or so, even more preferably from about 60 to 100% or so, and a tenacity of from about 0.15 to 3.5 N/tex or so, more preferably from about 0.5 to 3.5 N/tex or so.

Another preferred embodiment of the heat-resistant crimped yarn of the invention, in which the heat-resistant high-functional fibers are meta-aramid fibers, has an elongation percentage in stretch of at least about 6% or so, more preferably at least about 50% or so, even more preferably from about 50 to 300% or so, still more preferably from about 70 to 300% or so, a stretch modulus of elasticity of at least about 40% or so, more preferably from about 50 to 100% or so, even more preferably from about 70 to 100% or so, and a tenacity of from about 0.15 to 1.0 N/tex or so.

The heat-resistant crimped yarn of the invention is characterized in that it does not substantially deteriorate under heat. Quality deterioration under heat means that the physical properties of the heat-resistant crimped yarn are lowered and the appearance thereof is worsened while or after the yarn is processed under heat. More concretely, for example, the tenacity of the yarn is lowered, the color thereof is changed, and the yarn fluffs or is cut or broken as a result of the heat treatment. One criterion indicating the absence of the tenacity reduction is that the tenacity retention of the yarn after heat treatment is at least 30%, preferably at least 40%, more preferably at least 50%. The tenacity retention is represented by the following formula:

$$\text{Tenacity Retention (\%)} = \{\text{tenacity of heat-resistant crimped yarn (N/tex)}/\text{tenacity of heat-resistant high-functional fiber filaments not processed under heat (N/tex)}\} \times 100.$$

The color change of the yarn after heat treatment depends on the type of the heat-resistant high-functional fibers that constitute the yarn, and indiscriminately discussing it shall be evaded herein. For example, one criterion indicating the absence of color change of the yarn that comprises meta-aramid fibers may be that the lightness of the yarn after heat treatment is at least about 80% or so, preferably at least 85% or so of the lightness of the yarn before heat treatment.

The invention provides a bulky and stretchable fibrous product made of the heat-resistant crimped yarn. The fibrous product may be made of the heat-resistant crimped yarn only, or may be a mixed-woven or mixed-knitted product of the yarn with any other type of yarn of different fibers. For the mixed-woven or mixed-knitted product, however, it is desirable that the heat-resistant crimped yarn of the invention accounts for at least about 5% or so, more preferably at lest about 25% or so, even more preferably at least about 50% or so of the fibrous component of the product. Other types of yarn except the heat-resistant crimped yarn that may be in the product are not specifically defined, and may be any known ones.

The fibrous product of the invention is not specifically defined, including, for example, fabrics made by weaving or knitting yarn which contains the heat-resistant crimped yarn; clothes made of the fabrics, for example, gloves such as heat-resistant safety gloves, fireman's clothes, racer's clothes, steel worker's clothes, welder's clothes, painter's clothes and the like for use in high risk of exposure to flames and high-temperature heat; heat-resistant materials for industrial use such as heat-resistant dust-collecting filters, etc.; ropes, tire cords, etc.

The fibrous product can be produced with ease in any per-se known method. For example, for producing gloves, favorably used are commercially-available computer glove knitting machines, SFG and STJ (from Shima Precision Machinery).

The fibrous product may be used either singly or as combined with any other heat-resistant or flame-retardant products. If desired, the fibrous product may be processed in any per-se known manner. For example, the gloves of the invention may be directly used in various working activities, or, as the case may be, a part of each glove, especially the outer surface of the palm thereof or the entire outer surface thereof may be coated with resin. The resin for the purpose includes, for example, polyvinyl chloride resin, latex, polyurethane resin, natural rubber, synthetic rubber, etc. Coated with such resin, the mechanical strength of the gloves increases and the gloves are not slippery in holding objects. Coating the gloves with resin may be effected in any per-se known manner. Over the gloves of the invention, one may wear any other rubber gloves or elastomer gloves.

The invention further provides a method for producing heat-resistant crimped yarn practicable in point of the productivity, the necessary equipment and the production costs.

The method comprises twisting heat-resistant high-functional fiber filaments such as aramid fiber filaments, heat-setting them through treatment with high-temperature high-pressure steam or high-temperature high-pressure water (this is hereinafter referred to as high-temperature high pressure steam treatment) or through dry heat treatment, and thereafter untwisting them. The heat-resistant high-functional fiber filaments may be spun yarn or filament yarn prepared in any per-se known manner. Especially preferred is filament yarn, as fluffing little and releasing little dust.

More concretely, in general, heat-resistant high-functional fiber filaments are first twisted (this is the primary twisting step in which the filaments are twisted in the direction of S or Z); then optionally wound up around a heat-resistant bobbin of aluminum or the like; and heat-set for twist fixation at a temperature falling within a predetermined range. Next, these are untwisted by again twisting them in the direction opposite to the primary twisting (that is, in the direction of Z or S) to give the intended, heat-resistant crimped yarn.

In the method of the invention, each monofilament of the starting filaments is, after twisted in the primary twisting step, deformed to have complicated spiral morphology, and its morphology is fixed as it is through the heat treatment that follows the twisting step. Then, in the next untwisting step, the twisted monofilaments are released from the twisting force restraint but they still retain the primary-twisted morphology owing to their shape memory effect. As a result, the monofilaments individually act to restore their twisted situation based on their memory, and finally they are in the form of crimped yarn.

As so mentioned hereinabove, the method for producing the heat-resistant crimped yarn of the invention includes two different means for heat-setting, high-temperature high-pressure steam treatment and dry heat treatment.

The process of high-temperature high-pressure steam treatment has an advantage that the fiber filaments can be heated uniformly. Specifically, in the process, there is almost no probability that the fiber filaments are partly too much heated and are therefore deteriorated or, contrary to this, heating them is partly not enough and therefore they could not be fully heat-set.

On the other hand, the advantage of dry heat treatment is that (a) it does not require high-temperature high-pressure steam or high-temperature high-pressure water for treatment (hereinafter referred to as high-temperature high-pressure steam), and therefore the fiber filaments can be twisted and heat-set under atmospheric pressure, not requiring autoclaves, and (b) not only batch process but also continuous process of, for example, passing the fiber filaments in a high-temperature zone applies to it, and therefore, hot air as well as a fluidized bed may apply to the high-temperature zone.

The method of treatment with high-temperature high-pressure steam is described in detail hereinunder.

In the method, heat-resistant high-functional fiber filaments are first twisted in a primary twisting step. The filaments may be in any form of filament yarn or spun yarn. Preferred is filament yarn, as fluffing little and releasing little dust.

In the primary twisting step, preferably, the fiber filaments are twisted to a twist parameter, K represented by a formula, $K=t\times D^{1/2}$ (wherein t indicates the count of twists (/m) of the filaments, and indicates the fineness (tex) thereof), of from about 5,000 to 11,000 or so, more preferably from about 6,000 to 9,000 or so. The filaments are desired to be twisted to such a suitable degree that the yarn to be finally obtained is appropriately crimped, but if they are too much twisted, the fibers constituting them will be cut and damaged. To evade the problem, it is desirable that the twist parameter of the fiber filaments to be twisted falls within the defined range.

The twist parameter, K, is an index of indicating the degree of twisting of the fiber filaments, not depending on the thickness of the filaments. The larger the value of the twist parameter is, the higher the twist degree is.

In the primary twisting step, usable is any per-se known twisting machine, including, for example, a ring twister, a double twister, an Italy twister, etc.

Preferably, the twisted yarn is wound up around a bobbin. However, in case where the filaments are wound up around a bobbin while they are twisted, it is unnecessary to rewind them. The bobbin referred to herein is usually an ordinary cylindrical winding core around which yarn is wound up. Any per-se known bobbin is usable herein. For example, preferred are heat-resistant bobbins of aluminum or the like. Also preferably, the heat-resistant bobbin for use herein is worked to have small through-holes in its entire surface in order that high-temperature high-pressure steam can easily pass through it in the next heat-setting step.

Preferably, the thickness of the filament cheese or the filament cone formed by winding up the twisted yarn around the bobbin is at least about 15 mm; and the winding density thereof falls between about 0.4 and 1.0 g/cm$^3$ or so, more preferably between about 0.5 and 0.9 g/cm$^3$or so, even more preferably between about 0.6 and 0.9 g/cm$^3$ or so.

Next, the thus-twisted yarn is exposed to high-temperature high-pressure steam at a temperature falling within a specifically defined range. Through this high-temperature high-pressure steam treatment, the twisted yarn is heat-set.

The high-temperature high-pressure steam treatment may be effected in any per-se known manner. For example, the twisted yarn is processed in an autoclave with high-temperature high-pressure steam being introduced thereinto. For the treatment, any per-se known autoclave may be used. One example of the structure of the autoclave for use herein is equipped with a steam duct through which high-temperature high-pressure steam is fed thereinto; a water drainage valve; an exhaust valve via which the autoclave is degassed after treatment; an inlet mouth through which the bobbin with the twisted yarn being wound therearound in the previous step is led into it; and a lid capable of being opened and shut to hermetically seal it.

The temperature for the high-temperature high-pressure steam treatment may fall between about 130 and 250° C. or so, but preferably between about 130 and 220° C. or so, more preferably between about 140 and 200° C. or so, even more preferably between about 150 and 200° C. or so. The temperature range is preferred, as ensuring practicable crimped yarn not deteriorating the constituent fibers.

The pressure for the treatment is described. In case where the high-temperature high-pressure steam for the treatment is saturated steam, its pressure shall be physicochemically defined by its temperature. Concretely, the pressure of saturated steam at the lowermost temperature 130° C. is $2.70\times10^5$ Pa, and is $38.97\times10^5$ Pa at the uppermost temperature 250° C. Therefore, in the invention, the high-temperature high-pressure steam treatment is preferably effected at a temperature falling between about 130° C. and 250° C. or so and under a pressure falling between about $2.70\times10^5$ Pa and $39.0\times10^5$ Pa or so. However, the steam for the treatment in the invention is not limited to saturated steam only, and its pressure may fall between about $2.7\times10^5$ Pa and $39.0\times10^5$ Pa or so. Needless-to-say, the steam pressure could not be above the saturated steam pressure at the same temperature. Especially preferably, the high-temperature high-pressure steam treatment is effected at a temperature falling between about 130° C. and 220° C. or so and under a pressure falling between about $2.7\times10^5$ Pa and $23.2\times10^5$ Pa or so, more preferably at a temperature falling between about 140° C. and 220° C. or so and under a pressure falling between about $3.5\times10^5$ Pa and $23.2\times10^5$ Pa or so, even more preferably at a temperature falling between about 150° C. and 200° C. or so and under a pressure falling between about $4.8\times10^5$ Pa and $15.6\times10^5$ Pa or so.

In place of such high-temperature high-pressure steam, high-temperature high-pressure water can also be used herein. In this case, the water temperature may fall between about 130 and 250° C. or so, but preferably between about 130 and 220° C., more preferably between about 140 and 220° C. or so, even more preferably between about 150 and 200° C. or so; and the water pressure may fall between about $2.70\times10^5$ Pa and $39.0\times10^5$ Pa or so, more preferably between about $2.7\times10^5$ Pa and $23.2\times10^5$ Pa or so, even more preferably between about $3.5\times10^5$ Pa and $23.2\times10^5$ Pa or so, still more preferably between about $4.8\times10^5$ Pa and $15.6\times10^5$ Pa or so. For the high-temperature high-pressure water treatment, the expressions "high-temperature high-pressure steam" and "steam" given hereinabove and hereinunder shall be replaced by "high-temperature high-pressure water" and "water", respectively.

The time for the high-temperature high-pressure steam treatment is not indiscriminately defined, as varying depending on the amount of the filaments wound around a bobbin to be exposed to high-temperature high-pressure steam. It is enough that the filaments are kept at the predetermined temperature for a few minutes. Preferably, however, the time for the treatment falls between about 2 and 100 minutes or so, more preferably between about 3 and 60 minutes or so. The defined range of the time for the treatment is preferred for more uniformly heat-setting both the surface and the inside of the filaments wound around a bobbin, not deteriorating the constituent fibers. After having been thus treated with such high-temperature high-pressure steam, the filaments wound around a bobbin may be forcedly cooled by applying cold air thereto, but are preferably cooled in room-temperature air.

After treated with high-temperature high-pressure steam, the twisted yarn is untwisted by again twisting it in the direction opposite to the primary twisting, and the heat-resistant crimped yarn of the invention is thus produced. In the untwisting step, also used is any per-se known twisting machine, like in the primary twisting step.

Next described is the method of dry heat treatment.

For dry heat treatment, any mode of batch operation or false-twisting operation can be used, in which neither high-temperature high-pressure steam nor high-temperature high-pressure water is used for heat-setting. Namely, heat treatment with neither high-temperature high-pressure steam nor high-temperature high-pressure water is referred to as dry heat treatment.

In any mode of batch operation or false-twisting operation, the dry heat treatment may be optionally followed by thermal relaxation. Concretely, for example, the crimped yarn is thermally relaxed, while it is stretched in some degree. The advantage of such thermal relaxation is that the torque of the crimped yarn can be reduced, not detracting from the bulkiness of the yarn.

The batch process of dry heat treatment is described.

In the method, heat-resistant high-functional fiber filaments are first twisted in the primary twisting step. The filaments may be in any of filament yarn or spun yarn. However, preferred is filament yarn, since it fluffs little and releases little dust as mentioned hereinabove. In the primary twisting step, preferably, the fiber filaments are twisted to a twist parameter, K of from about 5,000 to 11,000 or so, more preferably from about 6,000 to 9,000 or so. The filaments are desired to be twisted to such a suitable degree that the yarn to be finally obtained is appropriately crimped, but if they are too much twisted, the fibers constituting them will be cut and damaged. To evade the problem, it is desirable that the twist parameter of the fiber filaments to be twisted falls within the defined range.

In the primary twisting step, usable is any per-se known twisting machine, including, for example, a ring twister, a double twister, an Italy twister, etc.

Preferably, the twisted yarn is wound up around a bobbin. However, in case where the filaments are wound up around a bobbin while they are twisted, it is unnecessary to rewind them. Any per-se known bobbin is usable herein. For example, preferred are heat-resistant bobbins of aluminum or the like.

Next, the thus-twisted yarn is heat-set through dry heat treatment at a temperature falling within a specifically defined range.

The temperature for the heat treatment shall be lower than the decomposition point of the constituent fibers. Preferably, it falls between about 140 and 390° C. or so, more preferably between about 170 and 350° C. or so, most preferably between about 200 and 330° C. or so. Through the heat treatment within the preferred temperature range, the yarn is crimped to a level suitable to practical use, and is not deteriorated. The dry heat treatment of the invention does not require high temperatures over the decomposition point of the constituent fibers. Through the treatment, therefore, the yarn is not substantially deteriorated. For example, the tenacity of the yarn is not lowered; the color thereof does not change; and the yarn does not fluff, and is not cut or damaged. Concretely, one criterion indicating the absence of the tenacity reduction is that the tenacity retention of the yarn after heat treatment is at least 30%, preferably at least 40%, more preferably at least 50%. The tenacity retention is represented by the numerical formula mentioned above. The color change of the yarn after heat treatment depends on the type of the heat-resistant high-functional fibers that constitute the yarn, and indiscriminately discussing it shall be evaded herein. For example, in the case of meta-aramid fibers, one criterion indicating the absence of color change of the yarn may be that the lightness of the yarn after heat treatment is at least about 80% or so, preferably at least 85% or so of the lightness of the yarn before heat treatment.

The heater for heat treatment maybe any of contact heaters or non-contact heaters. Heating the yarn may be effected in any per-se known manner with hot air or by the use of a fluidized-bed heating system.

The heating time for batch operation shall not be indiscriminately discussed, as varying depending on the type of the constituent fibers, the thickness of the filaments and the heating temperature. In general, however, it preferably falls between about 2 and 100 minutes or so, more preferably between about 10 and 100 minutes or so, even more preferably between 20 and 40 minutes or so. The defined range of the time for the treatment is preferred for more uniformly heat-setting both the surface and the inside of the filaments wound around a bobbin, not deteriorating the constituent fibers.

The dry heat treatment may be affected under increased pressure, reduced pressure or atmospheric pressure. Preferably, it is affected under atmospheric pressure.

After having been thus heat-set through dry heat treatment, the twisted yarn is untwisted by again twisting it in the direction opposite to the primary twisting direction, and the heat-resistant crimped yarn of the invention is thus produced. After treating with heat, the yarn may be forcedly cooled with cold air, but is preferably left cooled in room-temperature air. In the untwisting step, also used is any per-se known twisting machine, like in the primary twisting step.

Next described is the false-twisting method.

In the false-twisting method, the yarn unwound from the filament cheese (this is wound around a cylindrical winding core, bobbin) via a let-off roller is rewound up around a winding bobbin, after having been led thereto via a take-up roll. Between the let-off roll and the take-up roll, disposed is a false-twisting spindle. The yarn running in the manner is nipped by the false-twisting spindle, while being wound around the pin of the spindle, and the spindle is rotated in that condition, whereby the yarn running between the let-off roll and the false-twisting spindle is twisted in the direction S. With that, the thus-twisted yarn is heat-set, and then this is again twisted in the opposite direction, for example in the direction Z, between the false-twisting device and the take-up roller, whereby the yarn is untwisted to be crimped yarn. The space between the false-twisting device and the take-up roll is a cooling zone, in which the yarn is preferably left cooled with air. In place of using the false-twisting spindle in the manner as above, the yarn may be false-twisted in a different manner. For example, the yarn is brought into contact with the inner wall of a cylinder rotating at high speed or with the outer periphery of a disc also rotating at high speed, or with the surface of a belt running at high speed, whereby the yarn is false-twisted owing to the friction against the rotating or running medium.

In the false-twisting method, the heat-resistant high-functional fiber filaments may be either filament yarn or spun yarn. However, preferred is filament yarn, as fluffing little.

When the yarn is twisted by the use of a false-twisting spindle, its twist parameter K preferably falls between about 5,000 and 11,000 or so, more preferably between about 6,000 and 9,000 or so. This is in order that the yarn can be crimped to a desired degree and the constituent fibers are prevented from being cut or damaged.

In this method, the yarn may be twisted in any desired manner, for example, using a spindle, a nip belt, etc., and the twisting mode is not specifically defined. In the method of twisting the yarn with a spindle, usable is a single-pin spinner. In the invention, however, preferred are multi-pin spinners, for example, four-pin spinners. In case where yarn is twisted with a single-pin spinner that is generally used in the spindle-twisting method, heat-resistant high-functional fiber filaments must be wound once around the pin. In that case, however, the yarn of heat-resistant high-functional fiber filaments may be cut or damaged while being twisted, since the filaments are easily cut by friction. Contrary to this, in case where a multi-pin spinner, especially a four-pin spinner in which two upper pins and two lower pins are alternately aligned is used, and when the yarn to be twisted is passed in zigzags through the space between the neighboring pins so that the yarn can enter the spindle through the upper center part thereof and can go out through the lower center part thereof, then the yarn can be twisted more efficiently. In that case, the yarn is folded between the neighboring pins and is therefore twisted by frictional resistance therebetween.

The temperature for the heat-setting treatment in the false-twisting method is the same as that in the batch method mentioned hereinabove. However, the heat treatment effect in the false-twisting method is higher than that in the batch method. Therefore, the heating time in the false-twisting method may fall between about 0.5 and 300 seconds or so, preferably between about 1 and 120 seconds or so, though depending on the thickness of the yarn to be processed therein.

Like in the batch method, the heater for heat treatment in the false-twisting method may be any of contact heaters or non-contact heaters. Heating the yarn may be effected in any per-se known manner with hot air or by the use of a fluidized-bed heating system. Even when a contact heater is used in the false-twisting method, tar-like mist deposits little in the heating line. Therefore, even yarn of aramid fibers, which often release tar-like mist deposits, can be stably processed according to the false-twisting method, not requiring frequently cleaning the surface of the line on which the yarn being processed runs.

Like in the batch method, the dry heat treatment in the false-twisting method may be affected under increased pressure, reduced pressure or atmospheric pressure. Preferably, it is affected under atmospheric pressure.

The heat-resistant crimped yarn of the invention can be produced in any other method such as that mentioned below, not limited to the production methods mentioned hereinabove. For example, heat-resistant high-functional fiber filaments are knitted into a knitted fabric, then the knitted fabric is heat-set, and thereafter unknitted into heat-resistant crimped yarn. For heat-setting the knitted fabric in the method, the fabric may be subjected to the above-mentioned high-temperature high-pressure steam treatment or dry heat treatment. The details of the condition for the treatment may be the same as those mentioned hereinabove. In this method, preferred is high-temperature high-pressure steam treatment.

When the knitted fabric is prepared in the method, the degree of twisting the filaments is preferably lower, as the fabric restrains the constituent filaments. For example, it is desirable that the twist parameter of the filaments falls between 0 and 500, more preferably nearer to 0.

The invention is described concretely with reference to the following Examples.

The physical properties of the samples produced are measured and evaluated according to the methods mentioned below.

Critical Oxygen Index:

Measured according to JIS K7201 (1999) that indicates a combustion test for polymer materials based on the critical oxygen index of tested samples.

Thermal Decomposition Point:

Measured according to JIS K7120 (1987) that indicates a method for measuring the thermal weight loss of plastics.

Elasticity:

Measured according to JIS L1013 (1999) that indicates a method for testing filament yarn of chemical fibers. According to the Test Method 8.11.A, the elongation percentage in stretch and the stretch modulus of elasticity of each sample are determined.

Fineness:

Measured according to JIS L1013 (1999) that indicates a method for testing filament yarn of chemical fibers. According to the Test Method 8.3, the fineness based on the corrected weight of each sample is determined.

Tensile Strength:

Measured according to JIS L1013 (1999) that indicates a method for testing filament yarn of chemical fibers. According to the Test Method 8.5.1, the tensile strength of each sample is determined. In order to prevent the monofilaments in each sample tested from being disordered and to ensure uniform stress to all the constituent mono-filaments, the sample is twisted to a twist parameter, K of 1000, before tested.

Snarl Index:

Measured according to JIS L1095 (1999) that indicates a method for testing ordinary spun yarn. According to the Test Method 9.17.2.B, the snarl index of each sample is determined.

EXAMPLE 1

Used was polyparaphenylene-terephthalamide fiber filament yarn (Toray-DuPont's Commercial product named Kevlar®) having a critical oxygen index of 29, a thermal decomposition point of 537° C., a tensile strength of 2.03 N/tex, and a tensile modulus of 49.9 N/tex. This is composed of 1000 monofilaments each having a fineness of 0.167 tex, and its fineness is 167 tex. The yarn was first twisted to a twist parameter K of 6308 by the use of a ring twister (Kakigi Seisakusho's conjugated yarn twister, Model KCT), and then heat-set with saturated steam at 180° C. for 30 minutes. Next, using the same twister, the yarn was again twisted in the direction opposite to the primary twisting direction to a twist parameter 0, whereby this was untwisted to be crimped yarn of the invention. The physical properties of the crimped yarn were measured.

EXAMPLES 2, 3, AND COMPARATIVE EXAMPLES 1, 2

The same yarn as in Example 1 was twisted, heat-set with saturated steam or through dry heat treatment, and untwisted in the same manner as in Example 1, except that the twist parameter in the primary twisting step was varied as in Table 1. The physical properties of the crimped yarn obtained herein were measured.

In Examples 2 and 3, the twist parameter falls within the preferred range for the invention, while that in Comparative Examples 1 and 2 is lower than the preferred range.

EXAMPLE 4

The same yarn as in Example 1 was used herein, except that its fineness is 22.2 tex. The yarn was twisted to a twist parameter K of 5277 in the primary twisting step, then heat-set with saturated steam at 180° C., and then untwisted to be crimped yarn of the invention. The physical properties of the crimped yarn were measured.

The data of the samples in Examples 1 to 4 and Comparative Examples 1 and 2 are shown in Table 1. The relationship between the twist parameter of the yarn not heat-set with saturated steam and the elongation percentage in stretch, one typical characteristic of the crimped yarn is shown in FIG. 1. From the data in Table 1 and FIG. 1, it is understood that the elongation percentage in stretch of the yarn obtained in Examples 1 to 4 is enough for practical use, but that of the yarn obtained in Comparative Examples 1 and 2 is not. This is because the twist parameter of the yarn before heat treatment in the Comparative Examples is low.

TABLE 1

| | Fineness before treatment (tex) | Count of Twists (/m) | Twist Parameter (K) | Saturated Steam Treatment Temperature (° C.) | Saturated Steam Treatment Time (min) | Elongation Percentage in Stretch (%) | Stretch Modulus of Elasticity (%) | Fineness of Crimped Yarn (tex) | Tenacity (N/tex) |
|---|---|---|---|---|---|---|---|---|---|
| Example 1 | 167 | 488 | 6306 | 180 | 30 | 6.6 | 78.0 | 170.0 | 1.14 |
| Example 2 | 167 | 639 | 8258 | 180 | 30 | 11.9 | 84.5 | 175.6 | 0.96 |
| Example 3 | 167 | 763 | 9860 | 180 | 30 | 25.2 | 50.7 | 173.3 | 0.93 |
| Example 4 | 22.2 | 1120 | 5277 | 180 | 30 | 6.5 | 88.8 | 23.1 | 1.21 |
| Comp. Ex. 1 | 167 | 260 | 3360 | 180 | 30 | 2.3 | 57.8 | 167.8 | 1.67 |
| Comp. Ex. 2 | 167 | 375 | 4846 | 180 | 30 | 5.2 | 71.4 | 170.0 | 1.2 |

EXAMPLES 5 TO 7, AND COMPARATIVE EXAMPLE 3

Heat-resistant crimped yarn of the invention was obtained in the same manner as in Example 1, except that the twist parameter K in the primary twisting step was 8258 and the time for saturated steam treatment fell between 7.5 and 60 minutes as in Table 2.

Figure 2:
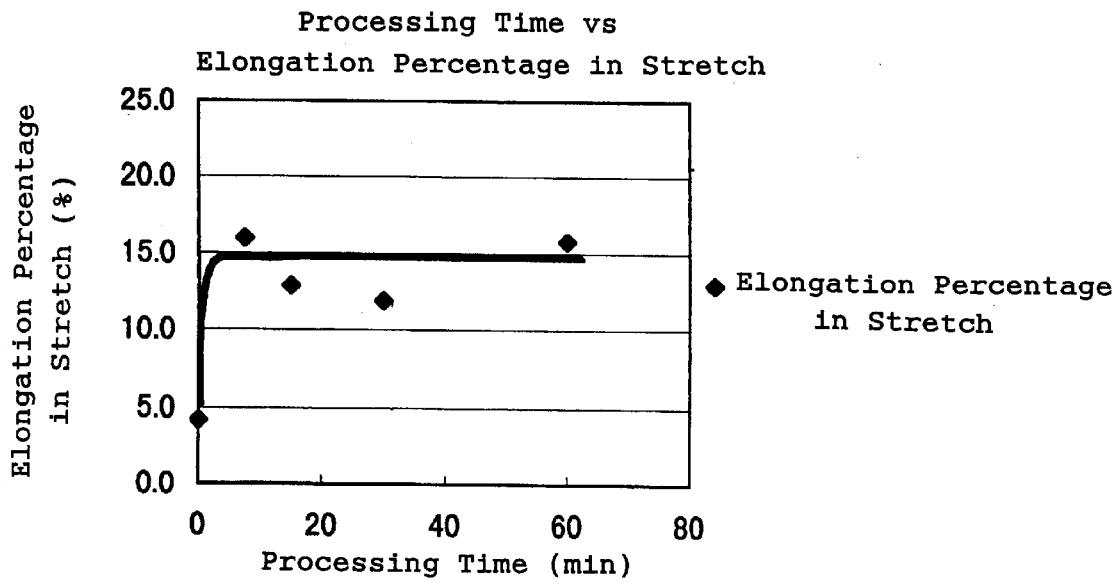
FIG. 2 shows the relationship between the processing time and the elongation percentage in stretch of crimped yarn.

In Comparative Example 3, the same yarn as in Examples 5 to 7 was twisted to the same degree without being subjected to saturated steam treatment as therein, then left at room temperature for 1 day and thereafter untwisted. The physical properties of the yarn of this Comparative Example 1 were also measured. The data are all given in Table 2. The relationship between the processing time and the elongation percentage in stretch of the crimped yarn is shown in FIG. 2. From the data of Examples 5 to 7, Example 2 and Comparative Example 3, it is understood that the elongation percentage in stretch of the crimped yarn does not vary so much even when the processing time is longer than 7.5 minutes. This means that the heating time may be short to obtain the heat-resistant crimped yarn of the invention.

EXAMPLES 11 TO 14, AND COMPARATIVE EXAMPLES 5, 6

The same yarn as in Example 1 was twisted to a twist parameter as in Table 4 by the use of a ring twister, and the twisted yarn was put into a hot air drier and subjected dry heat treatment under the condition shown in Table 4. Next, using the same twister, the yarn was again twisted in the direction opposite to the primary twisting direction to a twist parameter 0, whereby this was untwisted to be heat-resistant crimped yarn of the invention.

In Comparative Example 5, the yarn was processed in the same manner as in Example 11 except that the temperature for the dry heat treatment was 130° C.

In Comparative Example 6, the yarn was processed in the same manner as in Example 12 except that the twist parameter K was 4846.

Figure 3:
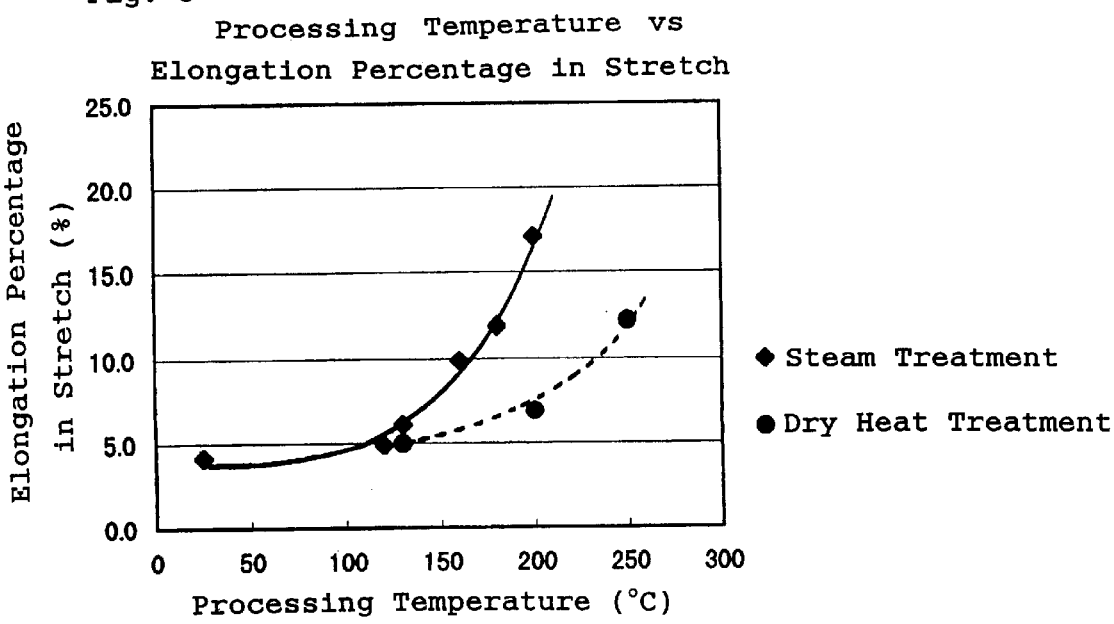
FIG. 3 shows the relationship between the processing temperature and the elongation percentage in stretch of crimped yarn.

The data are given in Table 4. The relationship between the processing temperature and the elongation percentage in stretch of the crimped yarn is shown in FIG. 3. Within the range tested, the elongation percentage in stretch of the crimped yarn that had been processed at higher temperatures either through treatment with high-temperature high-pressure steam or through dry heat treatment is higher. Under the condition herein, the elongation percentage in stretch of the crimped yarn processed through high-temperature high-pressure steam treatment is higher than that of the crimped yarn processed through dry heat treatment.

TABLE 2

| | Fineness before treatment (tex) | Count of Twists (/m) | Twist Parameter (K) | Saturated Steam Treatment Temperature (° C.) | Saturated Steam Treatment Time (min) | Elongation Percentage in Stretch (%) | Stretch Modulus of Elasticity (%) | Fineness of Crimped Yarn (tex) | Tenacity (N/tex) |
|---|---|---|---|---|---|---|---|---|---|
| Example 5 | 167 | 639 | 8258 | 180 | 7.5 | 16.0 | 72.1 | 170.0 | 0.88 |
| Example 6 | 167 | 639 | 8258 | 180 | 15 | 12.9 | 79.0 | 174.4 | 0.89 |
| Example 7 | 167 | 639 | 8258 | 180 | 60 | 15.8 | 61.9 | 170.0 | 0.74 |
| Example 2 | 167 | 639 | 8258 | 180 | 30 | 11.9 | 84.5 | 175.6 | 0.96 |
| Comp. Ex. 3 | 167 | 639 | 8258 | not treated | | 4.2 | 52.1 | 174.4 | 1.05 |

EXAMPLES 8 TO 10, AND COMPARATIVE EXAMPLES 3, 4

Heat-resistant crimped yarn of the invention was obtained in the same manner as in Example 1, except that the twist parameter K in the primary twisting step was 8258 and the temperature of the steam for heat-setting treatment fell between 130 and 200° C. as in Table 3.

In Comparative Example 4, crimped yarn was obtained in the same manner as above except that the temperature of the steam for heat-setting treatment was 120° C. The data are given in Table 3 along with those in Example 2 and Comparative Example 3. The relationship between the processing temperature and the elongation percentage in stretch of the crimped yarn is shown in FIG. 3. From these, it Is understood that the temperature of saturated steam for heat-setting treatment is preferably not lower than 130° C. for producing practicable crimped yarn.

In Comparative Example 5, the elongation percentage in stretch of the crimped yarn obtained is relatively low, since the temperature for the dry heat treatment for the yarn was 130° C. and was low. Accordingly, it is understood that the temperature for the dry heat treatment is preferably not lower than 140° C. In Comparative Example 6, the elongation percentage in stretch of the crimped yarn obtained is also relatively low, since the count of twists in the primary twisting step is small. Accordingly, it is understood that the twist parameter in the primary twisting step is preferably at least 5,000.

TABLE 3

| | Fineness before treatment (tex) | Count of Twists (/m) | Twist Parameter (K) | Saturated Steam Treatment Temperature (° C.) | Saturated Steam Treatment Time (min) | Elongation Percentage in Stretch (%) | Stretch Modulus of Elasticity (%) | Fineness of Crimped Yarn (tex) | Tenacity (N/tex) |
|---|---|---|---|---|---|---|---|---|---|
| Example 9 | 167 | 639 | 8258 | 160 | 30 | 9.9 | 65.2 | 171.1 | 0.67 |
| Example 10 | 167 | 639 | 8258 | 200 | 30 | 17.1 | 62.8 | 170.0 | 0.72 |
| Example 2 | 167 | 639 | 8258 | 180 | 30 | 11.9 | 84.5 | 175.6 | 0.96 |
| Example 8 | 167 | 639 | 8258 | 130 | 30 | 6.1 | 81.3 | 175.5 | 1.04 |
| Comp. Ex. 4 | 167 | 639 | 8258 | 120 | 30 | 4.9 | 55.6 | 173.4 | 0.98 |
| Comp. Ex. 3 | 167 | 639 | 8258 | not treated | | 4.2 | 52.1 | 174.4 | 1.05 |

TABLE 4

| | Fineness before treatment (tex) | Count of Twists (/m) | Twist Parameter (K) | Dry Heat Treatment Temperature (° C.) | Dry Heat Treatment Time (min) | Elongation Percentage in Stretch (%) | Stretch Modulus of Elasticity (%) | Fineness of Crimped Yarn (tex) | Tenacity (N/tex) |
|---|---|---|---|---|---|---|---|---|---|
| Example 11 | 167 | 639 | 8258 | 200 | 30 | 6.9 | 79.0 | 171.1 | 0.96 |
| Example 12 | 167 | 639 | 8258 | 250 | 30 | 12.2 | 81.6 | 167.8 | 0.96 |
| Example 13 | 167 | 763 | 9860 | 250 | 30 | 15.4 | 45 | 173.3 | 0.93 |
| Example 14 | 167 | 639 | 8258 | 250 | 7.5 | 12.8 | 72.1 | 170.0 | 0.88 |
| Comp. Ex. 5 | 167 | 639 | 8258 | 130 | 30 | 5.0 | 79.8 | 168.9 | 0.99 |
| Comp. Ex. 6 | 167 | 375 | 4846 | 250 | 30 | 4.4 | 76.2 | 170.0 | 1.2 |

EXAMPLE 15

The same filament yarn as in Example 1 except that its fineness is 22.2 tex was twisted to a count of twists of 1850/m (this corresponds to a twist parameter K of 8775) by the use of an Italy twister, and 500 g of the thus-twisted yarn was wound up around a flanged aluminum bobbin. In the same manner, prepared were two filament cheeses that had been twisted in opposite directions S, Z respectively, to the same count of twists. These were put into an autoclave for saturated steam treatment, and exposed to saturated steam at 180° C. for 30 minutes. After cooled, the yarn was again twisted in the opposite to the primary twisting direction to a twist parameter of 0. Thus untwisted, heat-resistant crimped yarn of the invention was obtained.

The elongation percentage in stretch of the crimped yarn was 17.1%. The crimped yarn had some residual torque. To cancel their residual torque, the crimped yarns differing in the torque direction of S or Z were paralleled to each other. The paralleled yarn has a total fineness of 88 tex. This was fed into a seamless glove knitting machine, Shima Precision Machinery's SFG-10G Model, and knitted into working gloves of the invention. The cut protection performance of the thus-knitted gloves was measured according to ASTM F1790-97, and was 6.8 N.

On the other hand, paralleled yarn was prepared by paralleling six, commercially-available woolly polyester filament yarns each having a fineness of 16.5 tex (the yarn is from Toray, and this is composed of 48 mono-filaments), for comparison to the heat-resistant crimped yarn of the invention produced in the above. The paralleled yarn had a total fineness of 99 tex. This was knitted into gloves in the same manner as above, and the cut protection performance of the gloves was measured also in the same manner as above, and was 3.5 N. From the data, it is understood that the cut protection performance of the gloves of the invention is better than that of the comparative gloves.

As being made of the crimped yarn, the working gloves of the invention produced herein fluffs little when compared with those made of spun yarn, Kevlar®. In addition, since they are thin and highly elastic, workers wearing them can handle fine machine parts with ease. Accordingly, the gloves are favorable to, for example, workers who weld electronic parts or who fabricate them in clean rooms, as well as to painters who paint aluminum construction materials, parts of electric and electronic appliances for household use, automobile parts, etc., for ensuring safety work in such production liens and for protecting such workers and painters from being burned and injured by edged tools or parts.

EXAMPLE 16

500 g of the same yarn having been twisted under the same condition as in Example 15 was wound up around an aluminum bobbin, and processed in high-temperature high-pressure water at 180° C. for 10 minutes. Then, this was cooled, desiccated and dried. Next, this was again twisted in the direction opposite to the primary twisting direction, to a twist parameter 0 by the use of an Italy twister, like in Example 15. Thus untwisted, heat-resistant crimped yarn of the invention was obtained. Its elongation percentage in stretch was 18%. As being uniformly heat-set, the crimped yarn was uniform as a whole.

EXAMPLE 17

500 g of the same yarn having been twisted under the same condition as in Example 15 was wound up around an aluminum bobbin, and exposed to hot air at 250° C. with a hot air drier for 30 minutes. After left cooled in air, this was again twisted in the direction opposite to the primary twisting direction, to a twist parameter 0 by the use of an Italy twister, like in Example 15. Thus untwisted, heat-resistant crimped yarn of the invention was obtained. Its elongation percentage in stretch was 12%. In this process, however, the heat transmission into the inside area of the yarn layer wound around the bobbin was not enough, and the yarn could not be uniformly heat-set. As a result, the elongation percentage in stretch of the part of the yarn not uniformly heat-set was low, and the yarn was not crimped uniformly. This is not practicable.

However, the problem was solved by reducing the thickness of the yarn layer wound around the bobbin to a half. In that manner, if the yarn layer wound around the bobbin is too thick, the yarn could not be uniformly heat-set in dry heat treatment and the yarn could not be crimped uniformly. Therefore, when the crimped yarn of the invention is produced through dry heat treatment, it is desirable that the yarn layer wound around a bobbin is not too thick.

EXAMPLE 18

This Example is to demonstrate continuous production of heat-resistant crimped yarn of the invention in a false-twisting process. Concretely, a false-twisting unit is disposed in a space between a heating zone having a length of 10 m and an air-cooling zone having a length of 5 m. Yarn is twisted to a count of twists of 1760/m (this corresponds to a twist parameter K of 8258), and introduced into the zone. First, this is heat-set in the heating zone, and then untwisted in the air-cooling zone. The starting yarn is Kevlar® 22 tex of para-aramid fibers. This is the same as the yarn processed in Example 1 except that its fineness is 22 tex. The heating zone was heated at 300° C., and the feed speed of the yarn was 10 m/min. Regarding its physical properties, the heat-resistant crimped yarn produced herein had an elongation percentage in stretch of 12.5%, a stretch modulus of elasticity of 82.6%, a fineness of 22.9 tex, and a tenacity of 0.96 N/tex.

EXAMPLE 19

The crimped yarn of para-aramid fibers Kevlar® obtained in Example 18 had some residual torque. To cancel their residual torque, the crimped yarns differing in the torque direction of S or Z were paralleled to each other to obtain paralleled yarn. This was fed into a Shima Precision Machinery's 13-gauge seamless glove knitting machine, and knitted into thin gloves. Being different from gloves made of spun yarn, these gloves have the following advantages:

1) They are elastic and well fit worker's hands, and they do not interfere with the movement of worker's hands. Wearing them, workers can do their work with ease.

2) They fluff little, and are therefore favorable to work in clean rooms where no dust is allowed.

EXAMPLE 20

The same filament yarn of polyparaphenylene-terephthalamide fibers (Toray-DuPont's Commercial product named Kevlar®) as in Example 1 was twisted to a count of twists of 640/m (this corresponds to a twist parameter of 8270) by the use of a ring twister, then wound up around an aluminum bobbin, and heat-set through treatment with high-temperature high-pressure steam, and thereafter untwisted to a twist parameter of 0 by the use of the ring twister to be heat-resistant crimped yarn of the invention. The temperature in the high-temperature high-pressure steam treatment was 200° C., and the processing time was 15 minutes.

EXAMPLES 21 TO 24

Heat-resistant crimped yarn of the invention was produced in the same manner as in Example 20. In place of the polyparaphenylene-terephthalamide fibers used in Example 20, however, a high-elasticity type of polyparaphenylene-terephthalamide fibers (Toray-DuPont's Commercial product named Kevlar® 49) were used in Example 21; co-paraphenylene-3,4'-oxydiphenylene-terephthalamide fibers (Teijin's Commercial product named Technora®) were in Example 22; holaromatic polyester fibers (Kuraray's Commercial product named Vectran®) were in Example 23; and polybenzobisoxazole fibers (Toyobo's Commercial product named Zylon®) were in Example 24. As in Table 5, the twist parameter of the twisted yarn in these Examples differs from that in Example 20.

EXAMPLE 25

Heat-resistant crimped yarn of the invention was produced in the same manner as in Example 20. In this, however, filament yarn having a smaller fineness, 22.2 tex than that in Example 20 was used, and the number of twists per the unit length of the yarn was increased to 1600/m (see Table 5). Accordingly, in this, the yarn was twisted and untwisted by the use of a double twister (this is favorable to twisting yarn to a larger count of twists), being different from that in Example 20 where a ring twister was used.

EXAMPLE 26

Heat-resistant crimped yarn of the invention was produced in the same manner as in Example 25. In this, however, yarn of polymetaphenylene-isophthalamide fibers (DuPont's Commercial product named Nomex®) having a fineness of 22.2 tex was used in place of the polyparaphenylene-terephthalamide fibers used in Example 25.

The physical properties of the heat-resistant crimped yarn obtained in Examples 20 to 26 are shown in Table 5. In Table 5, the tensile strength, the tensile modulus, the thermal decomposition point, the critical oxygen index, and the fineness of the starting yarn are all the physical data of the filament yarn not processed into crimped yarn.

From the test data shown in Table 5, it is understood that the elongation percentage in stretch (this indicates the crimp degree) of all the crimped yarns produced in Examples 20 to 26 from different fiber filaments is 8.5% or more. In particular, the crimped yarn of para-aramid fibers, polyparaphenylene-terephthalamide fibers and co-polyparaphenylene-3,4'-oxydiphenylene-terephthalamide fibers, that of meta-aramid fibers, polymetaphenylene-isophthalamide fibers, and that of holaromatic polyester fibers had a high elongation percentage in stretch. Above all, the elongation percentage in stretch of the crimped yarn of meta-aramid fibers, polymetaphenylene-isophthalamide fibers was 104.6%, and it is comparable to the elongation percentage in stretch of ordinary crimped yarn of polyester fibers.

TABLE 5

| | Chemical Name (trade name is in the lower column) | Example 20 poly-paraphenylene-terephthalamide | Example 21 poly-paraphenylene-terephthalamide (high-elasticity type) | Example 22 copoly-paraphenylene-3,4'-oxydiphenylene-terepthalamide | Example 23 holaromatic polyester | Example 24 poly-paraphenylene-benzobi-soxazole | Example 25 poly-paraphenylene-tere-phthalamide | Example 26 poly-meta-phenylene-isophthala-mide |
|---|---|---|---|---|---|---|---|---|
| Physical Properties (unit) | | Kevlar ® | Kevlar ® 49 | Technora ® | Vectran ® | Zylon ® | Kevlar ® | Nomex ® |
| Tensile Strength | (N/tex) | 2.03 | 1.96 | 2.47 | 2.56 | 3.53 | 2.03 | 0.47 |
| Tensile Modulus | (N/tex) | 49.9 | 75 | 52 | 59 | 176.5 | 49.9 | 12.4 |
| Thermal Decomposition Point | (° C.) | 537 | 537 | 500 | 400 | 650 | 537 | 500 |
| Critical Oxygen Index | | 29 | 29 | 25 | 28 | 56 | 29 | 29 |
| Fineness of Starting Yarn | (tex) | 167 | 158 | 167 | 167 | 111 | 22.2 | 22.2 |

TABLE 5-continued

| | Chemical Name (trade name is in the lower column) | Example 20 poly-paraphenylene-terephthalamide | Example 21 poly-paraphenylene-terephthalamide (high-elasticity type) | Example 22 copoly-paraphenylene-3,4'-oxydiphenylene-terepthalamide | Example 23 holaromatic polyester | Example 24 poly-paraphenylene-benzobi-soxazole | Example 25 poly-paraphenylene-tere-phthalamide | Example 26 poly-meta-phenylene-isophthala-mide |
|---|---|---|---|---|---|---|---|---|
| Count of Twists | (t/m) | 640 | 640 | 660 | 660 | 780 | 1600 | 1600 |
| Twist Parameter | | 8270 | 8045 | 8529 | 8529 | 8218 | 7539 | 7539 |
| Elongation Percentage in stretch | (%) | 28.2 | 29.7 | 27.7 | 22.5 | 8.5 | 32.7 | 104.6 |
| Stretch Modulus of Elasticity | (%) | 64.7 | 46.8 | 40.1 | 45.8 | 56.1 | 75 | 97.5 |
| Tenacity of Crimped Yarn | (N/tex) | 1.40 | 1.33 | 1.66 | 1.71 | 2.47 | 1.42 | 0.33 |

EXAMPLE 27

One 22.2 tex filament yarn of polyparaphenylene-terephthalamide fibers (Toray-DuPont's Commercial product named Kevlar®) was fed into a circular knitting machine with 150 knitting needles in total aligned in a circle having a diameter of 91 mm, and knitted into a cylindrical fabric of sheeting (plain stitch fabric). The knitted fabric was exposed to saturated steam at 200° C. for 15 minutes. Next, this was left cooled in air, and then unknitted from its last end. Thus unknitted, this gave crimped yarn with its knitted morphology in memory. The elongation percentage in stretch of the crimped yarn was 35%; and the stretch modulus of elasticity thereof was 56%.

EXAMPLE 28

In the same manner as in Example 27, filament yarn of polymetaphenylene-isophthalamide fibers (DuPont's Commercial product named Nomex®) was knitted into a cylindrical fabric of sheeting (plain stitch fabric). The knitted fabric was heated by a hot air drier at 200° C. for 0.5 minutes. Next, this was cooled in air, and then unknitted from its last end. Thus unknitted, this gave crimped yarn. The tensile strength and the lightness of the crimped yarn were measured. Concretely, the yarn was set in a constant-speed tensile tester with its free length between the grips being 200 mm, and tested for its tensile strength, for which the tensile speed was 200 m/min. To measure the lightness of the yarn, used was a Suga Tester's SM color computer.

EXAMPLES 29, 30, AND COMPARATIVE EXAMPLES 7, 8

Crimped yarn was produced in the same manner as in Example 28, except that the knitted fabric was heated at different temperatures as in Table 6. In Examples 29 and 30, the temperature for the heat treatment fell within the preferred range in the invention; but in Comparative Examples 7 and 8, the temperature was higher than the preferred range in the invention.

Figure 4:
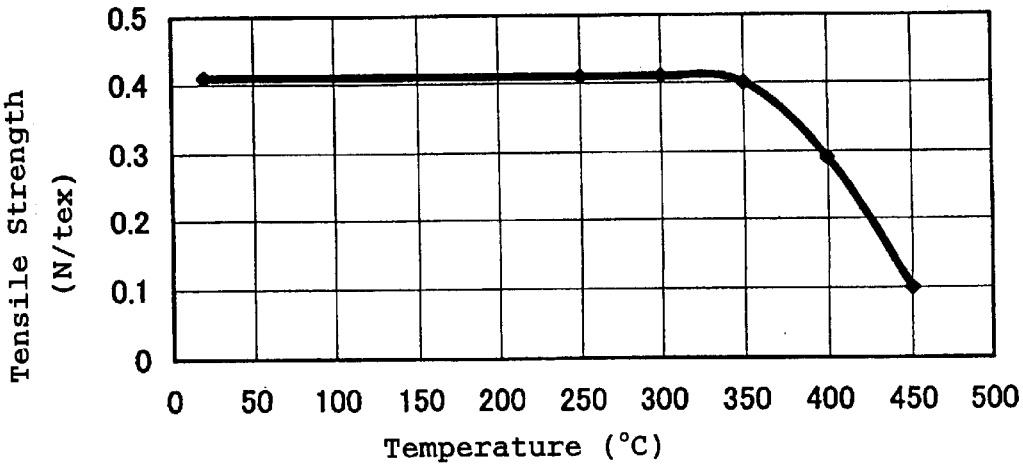
FIG. 4 shows the relationship between the temperature in dry heat treatment and the tensile strength of crimped yarn.
Figure 5:
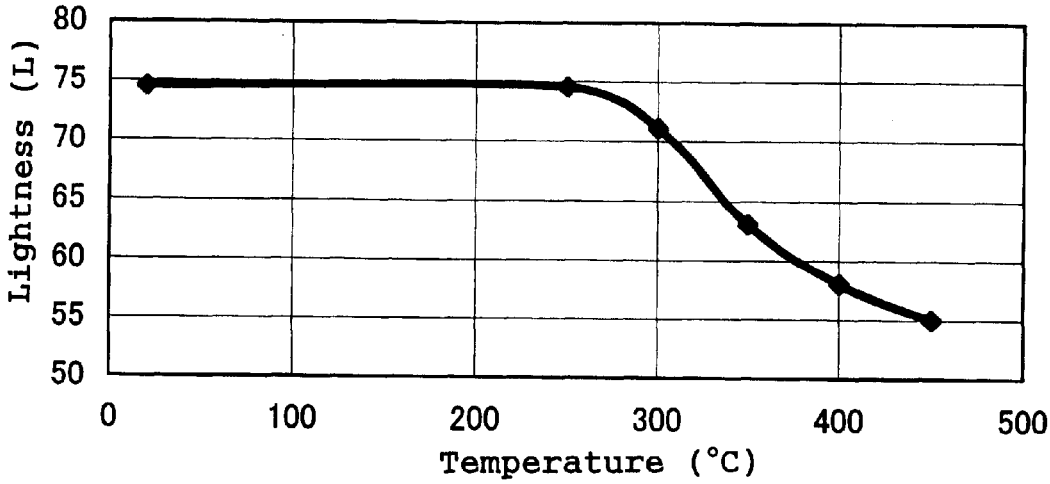
FIG. 5 shows the relationship between the temperature in dry heat treatment and the lightness of crimped yarn.

The test results are shown in Table 6. The relationship between the temperature in dry heat treatment and the tensile strength of the yarn is shown in FIG. 4; and the relationship between the temperature in dry heat treatment and the lightness of the yarn is in FIG. 5. As is obvious from FIG. 4, the tensile strength of the yarn lowered at 350 to 400° C. Also as in FIG. 5, the lightness of the yarn lowered at 350 to 400° C., and the meta-aramid fibers that had been originally white changed into dark brown.

TABLE 6

| | Condition for Heat Treatment | | Result in Tensile Test | | | | Data in Colorimetry | Result in Crimped Yarn Test | |
|---|---|---|---|---|---|---|---|---|---|
| | Temperature (° C.) | Time (min) | Tenacity (N) | Tenacity (N/tex) | Tenacity Retention (%) | Elongation at break (%) | Lightness (L) | Elongation Percentage in stretch (%) | Stretch Modulus of Elasticity (%) |
| non-processed | 20 | — | 9.05 | 0.41 | 100 | 17.1 | 74.5 | 5.5 | 92.5 |
| Example 28 | 250 | 0.5 | — | 0.41 | 100 | — | 74.5 | 23.7 | 91.1 |
| Example 29 | 300 | 0.5 | 9.07 | 0.41 | 100.2 | 17.1 | 71.1 | 50 | 74.8 |
| Example 30 | 350 | 0.5 | 8.71 | 0.40 | 96.2 | 14.7 | 63 | 46.2 | 91.5 |
| Comp. Ex. 7 | 400 | 0.5 | 6.36 | 0.29 | 70.3 | 11 | 58 | 52.5 | 88.3 |
| Comp. Ex. 8 | 450 | 0.5 | 2.22 | 0.10 | 24.5 | 9.0 | 55 | — | — |

INDUSTRIAL APPLICABILITY

The heat-resistant crimped yarn of the invention has excellent properties of heat resistance and flame retardancy intrinsic to heat-resistant high-functional fibers, and has a good elongation percentage in stretch, a good stretch modulus of elasticity and a good appearance, which conventional filament yarn and spun yarn could not have. While produced through heat treatment, the yarn of the invention is not substantially deteriorated. For example, the tenacity of the yarn does not lower, the color thereof does not change, and the yarn does not fluff and cut.

Therefore, fibrous products of the heat-resistant crimped yarn of the invention are resistant to heat and flames and are elastic. For example, gloves, working clothes and others made of the yarn well fit wearers, especially their hands. Wearing them, therefore, wearers can do their work and exercises with no difficulty, and feel good.

In addition, the heat-resistant crimped yarn of the invention fluffs little and release little dust. Therefore, fibrous products, especially working clothes and gloves made of the yarn are favorable to workers who work in clean rooms for fabricating precision machines, airplanes and information systems, as well as to painters who paint aluminum construction materials, parts of electric and electronic appliances for household use, automobile parts, etc.

The method for producing the heat-resistant crimped yarn of the invention is characterized by heat-setting twisted filaments through treatment with high-temperature high-pressure steam or through dry heat treatment. For the high-temperature high-pressure steam treatment in the method, usable is any ordinary autoclave or the like, in which the twisted filaments to be heat-set may be kept at a predetermined temperature for a short period of time. The dry heat treatment in the method may be affected generally under atmospheric pressure, and it may be affected in a continuous production line. Therefore, the advantages of the production method are that any ordinary equipment is enough for the method, the process control is easy, the production costs are reduced, and the productivity is high. Since the heat-setting treatment in the method is effected at temperature lower than the decomposition point of heat-resistant high-functional fibers, the yarn is prevented as much as possible from being deteriorated under heat.

What is claimed is:

1. A method for producing a heat-resistant crimped yarn, which comprises:

twisting heat-resistant high-functional fiber filaments to form a yarn, heat-setting the yarn through treatment with a high-temperature high-pressure steam or a high-temperature high-pressure water at a temperature between 130 and 250° C., and thereafter untwisting the yarn, to obtain the heat-resistant crimped yarn, wherein the heat-resistant high-functional fiber filaments are twisted to a twist parameter, K, represented by the following formula, of from 5,000 to 11,000, and are heat-set through treatment with the high-temperature high-pressure steam or the high-temperature high-pressure water at a temperature between 130 and 250° C.:

$$K=t\times D^{1/2}$$

wherein t indicates the count of twists (/m) of the filaments; and D indicates the fineness (tex) thereof.

2. The method for producing the heat-resistant crimped yarn as claimed in claim 1, wherein the heat-resistant high-functional fibers are selected from the group consisting of para-aramid fibers, meta-aramid fibers, holaromatic polyester fibers and polyparaphenylene-benzobisoxazole fibers.

3. The method for producing the heat-resistant crimped yarn as claimed in claim 2, wherein the para-aramid fibers are polyparaphenylene-terephthalamide fibers.

4. The method for producing the heat-resistant crimped yarn as claimed in claim 1, wherein the resultant heat-resistant crimped yarn has an elongation percentage in stretch of at least 6% and a stretch modulus of elasticity of at least 40%.

5. A method for producing a heat-resistant crimped yarn, which comprises:

twisting heat-resistant high-functional fiber filaments to form a yarn, heat-setting the yarn through a dry heat treatment at a temperature between 140 and 390° C., and thereafter untwisting the yarn to obtain the heat-resistant crimped yarn, wherein the heat-resistant high-functional fiber filaments are twisted to a twist parameter, K, represented by the following formula, of from 5,000 to 11,000, then the yarn is heat-set through the dry heat treatment at a temperature between 140 and 390° C., and thereafter the yarn is untwisted:

$$K=t\times D^{1/2}$$

wherein t indicates the count of twists (/m) of the filaments; and D indicates the fineness (tex) thereof.

6. The method for producing the heat-resistant crimped yarn as claimed in claim 5, wherein the heat-resistant high-functional fibers are selected from the group consisting of para-aramid fibers, meta-aramid fibers, holaromatic polyester fibers and polyparaphenylene-benzobisoxazole fibers.

7. The method for producing the heat-resistant crimped yarn as claimed in claim 6, wherein the para-aramid fibers are polyparaphenylene-terephthalamide fibers.

8. The method for producing the heat-resistant crimped yarn as claimed in claim 5, wherein the resultant heat-resistant crimped yarn has an elongation percentage in stretch of at least 6% and a stretch modulus of elasticity of at least 40%.

9. A method for producing a heat-resistant crimped yarn, which comprises:

knitting heat-resistant high-functional fiber filaments into a knitted fabric, then heat-setting the knitted fabric through a dry heat treatment at a temperature between 140 and 390° C. or through a treatment with a high-temperature high-pressure steam or a high-temperature high-pressure water at a temperature between 130 and 250° C., and thereafter unknitting the fabric, to obtain the heat-resistant crimped yarn, wherein the knitted fabric of heat-resistant high-functional fiber filaments is heat-set through treatment with the high-temperature high-pressure steam or the high-temperature high-pressure water at a temperature between 130 and 250° C. for a period of time between 2 and 100 minutes, and then the knitted fabric is unknitted.

10. The method for producing the heat-resistant crimped yarn as claimed in claim 9, wherein the resultant heat-resistant crimped yarn has an elongation percentage in stretch of at least 6.5%.

11. The method for producing the heat-resistant crimped yarn as claimed in claim 9, wherein the heat-resistant high-functional fibers are selected from the group consisting of para-aramid fibers, meta-aramid fibers, holaromatic polyester fibers and polyparaphenylene-benzobisoxazole fibers.

* * * * *